US005810334A

United States Patent [19]

Menaker

[11] Patent Number: 5,810,334

[45] Date of Patent: Sep. 22, 1998

[54] BLOCKING DEVICE AND COVER

[75] Inventor: Wayne Menaker, Lake Park, Fla.

[73] Assignee: Wayne J. Menaker, Lake Park, Fla.

[21] Appl. No.: 803,205

[22] Filed: Feb. 21, 1997

[51] Int. Cl.[6] ..... E04H 17/00

[52] U.S. Cl. ..... 256/12.5; 256/1; 256/25; 135/900

[58] Field of Search ..... 256/12.5, 24, 25, 256/45, 48, 73, 1, 26; 135/900, 901, 902, 907, 115, 119, 97

[56] References Cited

U.S. PATENT DOCUMENTS

| | | | |
|---|---|---|---|
| 1,315,497 | 9/1919 | Higdon et al. | 256/25 X |
| 2,652,845 | 9/1953 | O'Neill et al. | 135/902 X |
| 2,681,659 | 6/1954 | Hrinsin | 256/25 |
| 3,537,688 | 11/1970 | Stein | 135/902 X |
| 3,994,479 | 11/1976 | Johannesson | 256/24 |
| 4,303,226 | 12/1981 | Powell et al. | 256/25 |
| 4,543,745 | 10/1985 | Beck | 47/33 |
| 4,623,126 | 11/1986 | Pettit | 256/25 |
| 4,969,500 | 11/1990 | Makosa | 135/902 X |
| 4,997,061 | 3/1991 | Aymes | 182/106 |
| 5,029,819 | 7/1991 | Kane | 256/12.5 X |
| 5,033,719 | 7/1991 | Cardente | 256/12.5 X |
| 5,062,234 | 11/1991 | Green | 135/901 X |
| 5,080,123 | 1/1992 | Stein | 135/900 X |
| 5,415,194 | 5/1995 | Kaye | 135/119 X |

FOREIGN PATENT DOCUMENTS

| | | | |
|---|---|---|---|
| 104922 | 8/1938 | Australia | 135/902 |
| 2522051 | 8/1983 | France | 256/12.5 |
| 2611792 | 9/1988 | France | 256/24 |

*Primary Examiner*—Harry C. Kim

[57] ABSTRACT

A blocking device (10) having a shield (12) which has at least one shield barrier (12B) and at least two shield pole pockets (12A) each positioned at opposite distal ends of the shield barrier (12B). The blocking device (10) further has at least two poles (14) each having a pole shaft (14C) which is inserted within the at least two shield pole pockets (12A). The at least two pole shafts (14C) having sufficient length to extend downwardly therefrom.

16 Claims, 4 Drawing Sheets

BLOCKING DEVICE AND COVER

BACKGROUND OF THE INVENTION

1. Field of the Invention

The present invention relates to a blocking device. More particularly, the present invention relates to blocking device used primarily to block wind on a beach.

2. Description of the Prior Art

Blocking devices for wind and barriers for a garden are well known in the art. They normally constitute a fastening means and a blocking device rotatable thereon.

Numerous innovations for blocking devices have been provided in the prior art that are described as follows. Even though these innovations may be suitable for the specific individual purposes to which they address, they differ from the present invention as hereinafter contrasted.

In U.S. Pat. No. 5,502,929, titled Combination Wind and Sun Barrier, invented by Duane D. Daniels, a wind and sun barrier includes a barrier panel with a barrier screen effective to reduce wind velocity and to produce shade, the barrier panel pivotally mounted between a pair of supper posts. The barrier panel may be pivoted from a vertical position, for blocking wind, to a horizontal position, providing shade thereunder. Releasable lock mechanisms are provided to maintain the barrier in the desired position. A plurality of barrier panels may be aligned between a plurality of posts, to form an elongated barrier wall oriented either vertically or horizontally, depending upon the weather conditions.

The patented invention differs from the present invention because the patented invention is a screen that rotates about a horizontal axis. The screen functions as a wind break and sun screen. The screen is restrained in a position by a restraint means which includes a means for locking the screen in a vertical position. The patented invention does not have a retraction mens. The present invention is a fence which is retractable about a vertical axis by rolling about a mandril, it is extended manually. It is housed in a vertical housing which is inserted into an in ground on its lower end. Multiple devices may be linked together by securing a second fence to the first by an attachment means. The present invention specifically is intended to prevent children from crawling under the fence portion.

In U.S. Pat. No. 4,870,984, titled Portable Shelter with Wind Break, invented by Leo E. Rosh, a portable shelter having a pair of spaced apart runners supporting a frame carrying a suitable covering. A hinged plate extends between the runners and is shiftable between a lower position extending to the bottom of the runners for blocking the flow of air between the runners under the covering and a raised position to allow non-interfering movement of the shelter across the ground or ice.

The patented invention differs from the present invention because the patented invention is a portable shelter mounted on runners. The shelter can be pulled by an individual to a desired location. The shelter covering is attached to a frame which can be collapsed about a horizontal axis. The present invention is a fence which is retractable about a vertical axis by rolling about a mandril, it is extended manually. It is housed in a vertical housing which is inserted into an in ground on its lower end. Multiple devices may be linked together by securing a second fence to the first by an attachment means. The present invention specifically is intended to prevent children from crawling under the fence portion.

In U.S. Pat. No. 4,432,381, titled Windbreaker, invented by George Greenbaum, a windbreak which is formed of a post secured to a frame and sheet material is secured to the frame. The frame is comprised of grooved rods which secure the rods. The adjoining rods define channels and the clamp includes projections which extend into the channels. Fitting are secured to the upper ends of the rod of the post and the frame is secured to the fittings. Fittings are further secured to the frame by dowel-like members.

The patented invention differs from the present invention because the patented invention is a plurality of panels supported on frame. The individual panels rotate about a vertical axis. The panels are manufactured from sheet materials. The present invention is a fence which is retractable about a vertical axis by rolling about a mandril, it is extended manually. It is housed in a vertical housing which is inserted into an in ground on its lower end. Multiple devices may be linked together by securing a second fence to the first by an attachment means. The present invention specifically is intended to prevent children from crawling under the fence portion.

Numerous innovations for blocking devices have been provided in the prior art that are adapted to be used. Even though these innovations may be suitable for the specific individual purposes to which they address, they would not be suitable for the purposes of the present invention as heretofore described.

SUMMARY OF THE INVENTION

The present invention relates to a blocking device. More particularly, the present invention relates to blocking device used primarily to block wind on a beach. When utilized on the beach, it allows persons to enjoy the sun in adverse wind conditions by facing the device into the wind and placing towels or blankets for laying on therebehind.

The types of problems encountered in the prior art are most are quite cumbersome and cannot be easily ported to the beach.

In the prior art, unsuccessful attempts to solve this problem were attempted namely: bulky devices which rotate on a central axis. However, the problem was solved by the present invention because it is simple, lightweight, and easy to install.

Innovations within the prior art are rapidly being exploited in the field of beach products.

The present invention went contrary to the teaching of the art which teaches cumbersome, bulky and complicated devices.

The present invention solved a long felt need for a simple, lightweight and easy to install wind breaker for the beach.

The present invention produced unexpected results namely: when the device was constructed with four sides, it functioned as a portable baby crib for the beach.

Accordingly, it is an object of the present invention to provide a blocking device having a shield, a plurality of poles and an optional cover.

More particularly, it is an object of the present invention to provide the shield having a shield barrier with a plurality of shield pole pockets disposed vertically thereon.

In keeping with these objects, and with others which will become apparent hereinafter, one feature of the present invention resides, briefly stated, in each pole preferably having a pole shaft with a pole point positioned at a bottom distal end and a pole cap positioned at a top distal end.

When the cover is designed in accordance with the present invention, it has a plurality of cover holders each with a cover holder first distal end and a cover holder second distal end which are preferably securely fastened with cover tarp flaps of a cover tarp.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

10—blocking device (10)
12—shield (12)
12A —shield pole pocket (12A)
12B—shield barrier (12B)
14—pole (14)
14A—pole point (14A)
14B—pole cap (14B)
14C—pole shaft (14C)
16—cover (16)
16A—cover holder (16A)
16AA—cover holder first distal end (16AA)
16AB—cover holder second distal end (16AB)
16B—cover flap (16B)

DESCRIPTION OF THE PREFERRED EMBODIMENT

Figure 1:
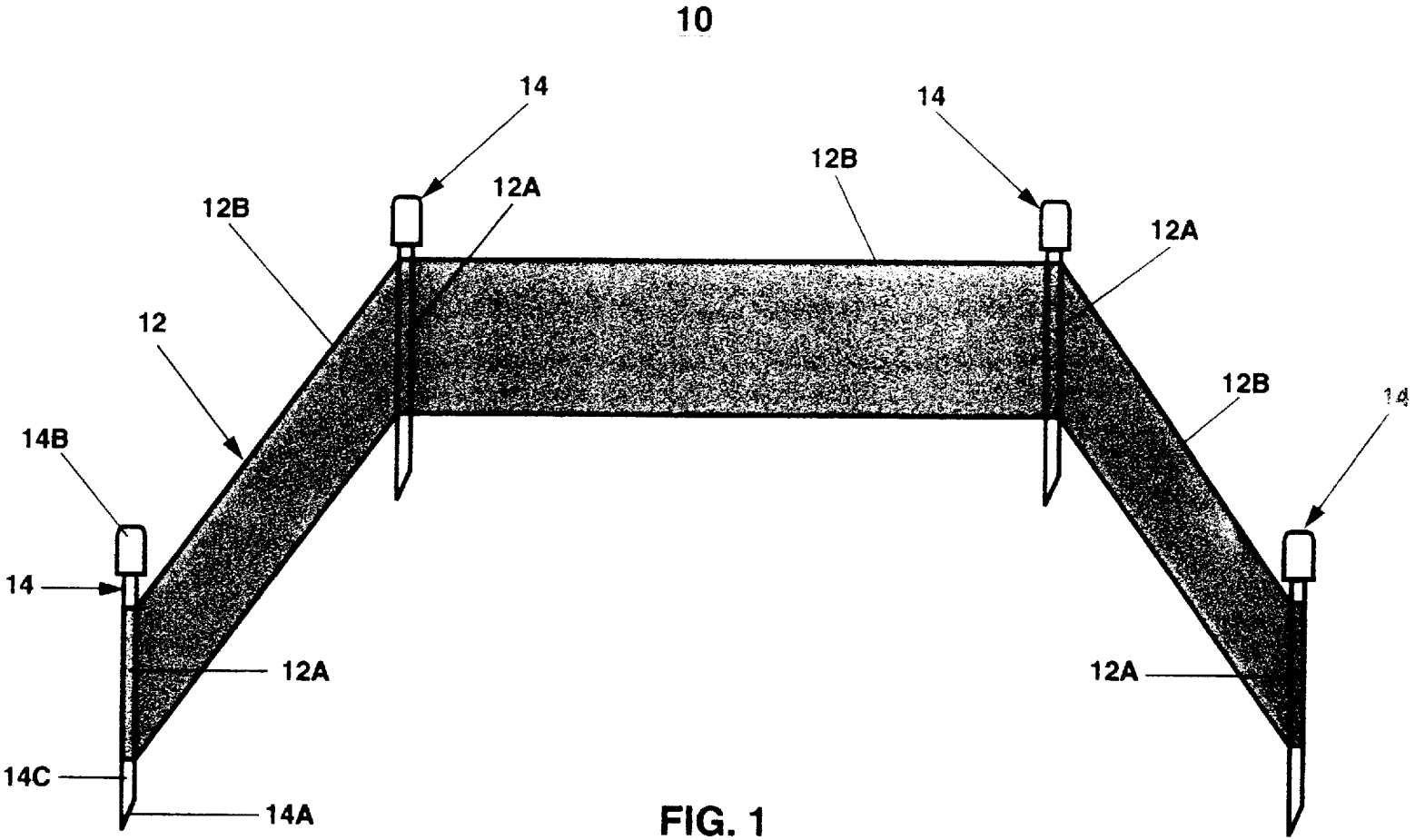
FIG. 1 is a perspective view of a blocking device.
Figure 4:
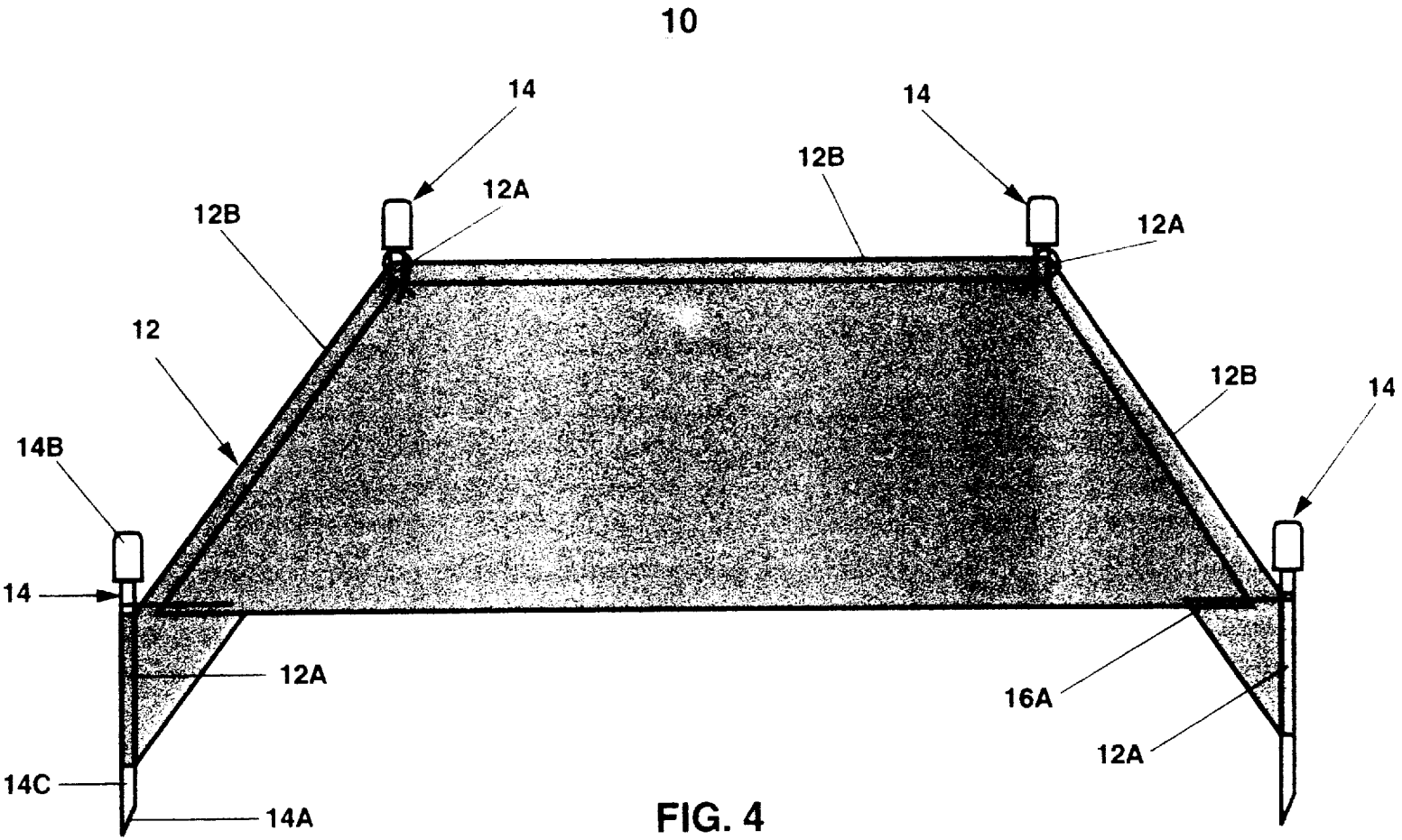
FIG. 4 is a perspective view of a blocking device with a cover attached thereto.

Referring to FIG. 1 and FIG. 4 which are a perspective view of a blocking device (10) without and with a cover (16), respectively. The blocking device (10) comprises a shield (12) which comprises at least one shield barrier (12B) and at least two shield pole pockets (12A) each positioned at opposite distal ends of the shield barrier (12B). Preferably three shield barriers (12B) and four shield pole pockets (12A) are utilized in the present invention. The blocking device (10) preferably comprises at least two shields (12) having at least three shield pole pockets (12A) within which at least three corresponding pole shafts (14C) are inserted. The blocking device (10) further comprises a cover (16) which comprises a cover tarp (16B) having at least three cover holders (16A) securely attached thereto and positioned at corresponding positions to the at least three corresponding pole shafts (14C). The at least three cover holders (16A) function to removably secure the cover (16) to the corresponding pole shafts (14C). The shield (12) is preferably constructed from a solid wind impervious material. The solid wind impervious material is selected from a group of materials consisting of plastic, plastic composites, rubber, rubber composites, metal, metal alloy, rubber, rubber composite, fiberglass, epoxy, carbon-graphite, and wood.

The shield (12) may optionally be constructed from a pervious material such as a screen. The pervious material is selected from a group of materials consisting of plastic, plastic composites, rubber, rubber composites, metal, metal alloy, rubber, rubber composite, fiberglass, epoxy, carbon-graphite, and wood.

The pole shaft (14C) further comprises a pole point (14A) positioned at the extending distal end. The pole point (14A) is at 45 degree angle which functions to facilitate insertion into ground or sand. The pole (14) further comprises a pole cap (14B) positioned at an opposite distal end of the pole shaft (14C) to the pole point (14A). The pole cap (14B) functions to prevent the pole shaft (14C) from being removed in an upwardly direction from the shield pole pocket (12A).

Figure 2:
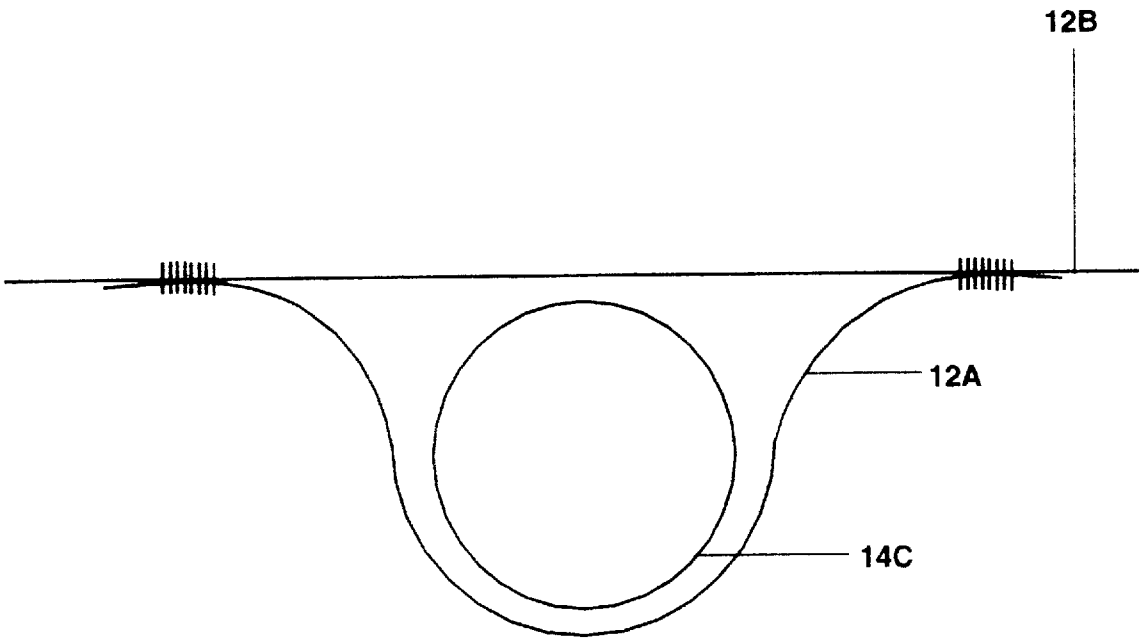
FIG. 2 is a top view of a pole shaft within a shield pole pocket.

Referring to FIG. 2 which is a top view of a pole shaft (14C) within a shield pole pocket (12A). The blocking device (10) further comprises at least two poles (14) each having a pole shaft (14C) which is inserted within the at least two shield pole pockets (12A). The at least two pole shafts (14C) having sufficient length to extend downwardly therefrom. The pole (14) is preferably constructed from a hollow tubular material. The hollow tubular material is selected from a group of materials consisting of plastic, plastic composites, rubber, rubber composites, metal, metal alloy, rubber, rubber composite, fiberglass, epoxy, carbon-graphite, and wood.

The pole (14) may optionally be constructed from a solid tubular material. The solid tubular material is selected from a group of materials consisting of plastic, plastic composites, rubber, rubber composites, metal, metal alloy, rubber, rubber composite, fiberglass, epoxy, carbon-graphite, and wood.

Figure 3:
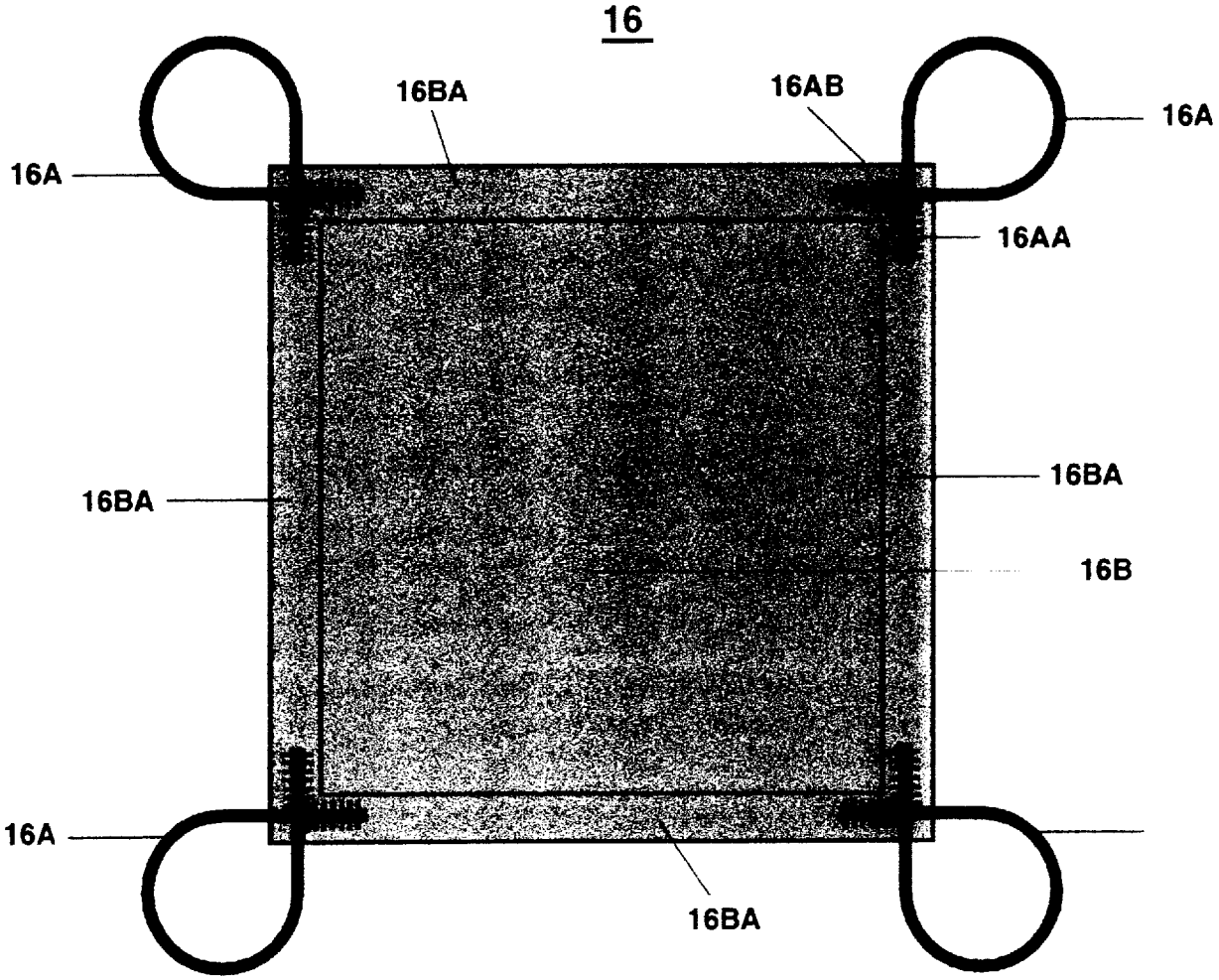
FIG. 3 is a bottom view of a cover.

Lastly, referring to FIG. 3 which is a bottom view of a cover (16). The cover holder (16A) is constructed from a stretchable resilient material such as a bungee cord. The bungee cord preferably comprises a cover holder first distal end (16AA) securely attached along one edge of the cover tarp (16B) and a cover holder second distal end (16AB) securely attached along an adjacent edge of the cover tarp (16B) forming a loop having sufficient size to accept a pole shaft (14C) therein. The bungee cord further comprises a cover holder first distal end (16AA) securely attached along one edge of the cover tarp (16B) within a cover tarp flap (16BA) and a cover holder second distal end (16AB) securely attached along an adjacent edge of the cover tarp (16B) within a cover tarp flap (16BA). The cover (16) is preferably constructed from a solid ultraviolet light impervious material. The solid ultraviolet light impervious material is selected from a group of materials consisting of plastic, plastic composites, rubber, rubber composites, metal, metal alloy, rubber, rubber composite, fiberglass, epoxy, carbon-graphite, and wood. The cover (16) may be optionally constructed from a pervious material.

It will be understood that each of the elements described above, or two or more together, may also find a useful application in other types of constructions differing from the type described above.

While the invention has been illustrated and described as embodied in a blocking device, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

1. A blocking device (10) comprising:

a shield (12) comprising at least two shield barriers (12B), said shield having at least three shield pole pockets (12A), each of the shield pole pockets (12A) being positioned at opposite distal ends and at an intermediate portion of the shield (12);

at least three poles (14) comprising pole shafts (14C) having sufficient lengths for being inserted through the corresponding shield pole pockets (12A) and extending upwardly and downwardly therefrom; and a cover (16) comprising a cover tarp (16B) having at least three cover holders (16A) for allowing the cover (16) to be removably secured to the corresponding pole shafts (14C), each of said cover holders (16A) being constructed from a stretchable resilient bungee cord having a cover holder first distal end (16AA) securely attached along one edge of the cover tarp (16B) within a cover tarp flap (16BA) and a cover holder second distal end (16AB) securely attached along an adjacent edge of the cover tarp (16B) within an adjacent cover tarp flap (16BA) to form a loop for accepting therein corresponding one of the upwardly extending pole shafts (14C) to removably secure the cover (16) to the shield (12).

2. The blocking device as described in claim 1, wherein each of the pole shafts (14C) comprises a pole point (14A) formed at a distal end thereof.

3. The blocking device as described in claim 2, wherein the pole point (14A) is at 45 degrees to facilitate insertion into ground or sand.

4. The blocking device as described in claim 2, wherein each of the poles (14) further comprises a pole cap (14B) positioned at a distal end opposite the pole point (14A) for preventing the shield (12) from being moved upwardly from the poles (14).

5. The blocking device as described in claim 1, wherein the shield (12) is constructed from a solid wind impervious material.

6. The blocking device as described in claim 5, wherein the solid wind impervious material is selected from a group of materials consisting of plastic, plastic composites, rubber, rubber composites, metal, metal alloy, fiberglass, epoxy, carbon-graphite, and wood.

7. The blocking device as described in claim 1, wherein the shield (12) is constructed from a pervious material.

8. The blocking device as described in claim 7, wherein the pervious material is selected from a group of materials consisting of plastic, plastic composites, rubber, rubber composites, metal, metal alloy, fiberglass, epoxy, carbon-graphite, and wood.

9. The blocking device as described in claim 1, wherein the cover (16) is constructed from a solid ultraviolet light impervious material.

10. The blocking device as described in claim 9, wherein the solid ultraviolet light impervious material is selected from a group of materials consisting of plastic, plastic composites, rubber, rubber composites, metal, metal alloy, fiberglass, epoxy, carbon-graphite, and wood.

11. The blocking device as described in claim 1, wherein the cover (16) is constructed from a pervious material.

12. The blocking device as described in claim 11, wherein the pervious material is selected from a group of materials consisting of plastic, plastic composites, rubber, rubber composites, metal, metal alloy, fiberglass, epoxy, carbon-graphite, and wood.

13. The blocking device as described in claim 1, wherein each of the poles (14) is constructed from a hollow tubular material.

14. The blocking device as described in claim 13, wherein the hollow tubular material is selected from a group of materials consisting of plastic, plastic composites, rubber, rubber composites, metal, metal alloy, fiberglass, epoxy, carbon-graphite, and wood.

15. The blocking device as described in claim 1, wherein each of the poles (14) is constructed from a solid material.

16. The blocking device as described in claim 15, wherein the solid material is selected from a group of materials consisting of plastic, plastic composites, rubber, rubber composites, metal, metal alloy, fiberglass, epoxy, carbon-graphite, and wood.

* * * * *